US009346599B2

(12) United States Patent
Strilich et al.

(10) Patent No.: US 9,346,599 B2
(45) Date of Patent: May 24, 2016

(54) FOOD PACKAGING

(71) Applicant: NESTEC S.A., Vevey (CH)

(72) Inventors: Erik Strilich, Roselle, IL (US); Bethanie L. Gasperson, Edwardsville, IL (US); Paul Andrew Cogley, Gurnee, IL (US); Alison Wilker, Park Ridge, IL (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/366,548

(22) PCT Filed: Dec. 17, 2012

(86) PCT No.: PCT/EP2012/075758

§ 371 (c)(1),
(2) Date: Jun. 18, 2014

(87) PCT Pub. No.: WO2013/092473

PCT Pub. Date: Jun. 27, 2013

(65) Prior Publication Data

US 2014/0346077 A1 Nov. 27, 2014

Related U.S. Application Data

(60) Provisional application No. 61/577,999, filed on Dec. 20, 2011.

(51) Int. Cl.

| | |
|---|---|
| ***B65B 25/06*** | (2006.01) |
| ***B65D 77/04*** | (2006.01) |
| ***B65D 81/26*** | (2006.01) |
| ***B65D 81/32*** | (2006.01) |

(52) U.S. Cl.

CPC ..... *B65D 77/04* (2013.01); *B65D 77/046* (2013.01); *B65D 81/26* (2013.01); *B65D 81/261* (2013.01); *B65D 81/3216* (2013.01)

(58) Field of Classification Search

CPC ..... B65D 77/046; B65D 81/3261; B65D 81/261; B65D 81/26; B65D 77/0446; B65D 21/0233; A23L 3/01; A23L 1/0128

See application file for complete search history.

(56) References Cited

U.S. PATENT DOCUMENTS

| | | | | |
|---|---|---|---|---|
| 2,944,694 | A * | 7/1960 | Kinsey | 206/541 |
| 2,974,843 | A * | 3/1961 | Reifers et al. | 229/407 |
| 4,697,703 | A | 10/1987 | Will | |
| 2007/0065545 | A1 | 3/2007 | Vovan | |
| 2010/0282636 | A1 | 11/2010 | Roberts et al. | |

FOREIGN PATENT DOCUMENTS

| | | |
|---|---|---|
| EP | 1832525 | 9/2007 |

* cited by examiner

*Primary Examiner* — Jeffrey Allen
(74) *Attorney, Agent, or Firm* — K&L Gates LLP

(57) ABSTRACT

Food packaging has a base tray and a second tray which nests in the base tray. The base tray has one or more walls terminating in a land. The land has an indent in its upper surface at least partially surrounded by an indent wall which extends continuously along an inward side of the indent so as to separate the indent from a main cavity formed by the base tray walls. The second tray nested has a flange supported by the land. The flange extends partially over the indent. The indent is sized to admit a finger within the indent below the flange. In consequence, after cooking of the foods in the trays, the consumer can use the indent in gripping the flange of the second tray without direct exposure to steam from the food cooked in the base tray. The consumer can then add a selected amount of food from the second tray to the base tray.

18 Claims, 8 Drawing Sheets

FOOD PACKAGING

BACKGROUND

This invention relates to food packaging.

A great variety of packaged convenience foods are available to a consumer. However, there is a continuing need for packaged convenience foods that suit the tastes of as many consumers as possible. Furthermore, a consumer will be drawn to a convenience food which can be prepared conveniently and safely, therefore, there is also a need for packaging for convenience foods that helps ensure convenient and safe preparation of the foods.

SUMMARY

An aspect of the present invention provides food packaging with a base tray and a second tray which nests in the base tray. The base tray has one or more walls terminating in a land. The land has an indent in its upper surface at least partially surrounded by an indent wall which extends continuously along an inward side of the indent so as to separate the indent from a main cavity formed by the base tray walls. The second tray has a flange supported by the land. The flange extends partially over the indent. The indent is sized to admit a finger within the indent below the flange. In consequence, after heating or cooking of the foods in the trays, the consumer can use the indent in gripping the flange of the second tray without direct exposure to steam from the food in the base tray. The consumer can then add a selected amount of food from the second tray to the base tray.

The land may be a circumferential lower land and there may be an upward step from the lower land to a circumferential upper land outbound of the lower land.

The flange of the second tray may be circumferential and an upper surface of the flange and an upper surface of the circumferential upper land of the base tray may lie in a common plane.

A topping film may be adhered to the circumferential upper land and to the flange.

The base tray may have an inwardly directed protuberance, with the indent being in an upper surface of the protuberance.

The protuberance may be located at a base tray side wall and the second tray may abut the protuberance and a base tray end wall, such that said second tray is located by the protuberance and the base tray end wall.

The land may be a protuberance land, the indent a protuberance indent, and the flange a first flange portion and the base tray may have a corner land with a corner indent in its upper surface at least partially surrounded by a corner indent wall, the corner indent wall extending continuously along an inward side of the corner indent so as to separate the corner indent from the main cavity formed by the base tray walls, and the second tray may have a second flange portion supported by the corner land, the second flange portion extending partially over the corner indent, the corner indent sized to admit a finger within the corner indent below the second flange portion.

The base tray side wall may be a first base tray side wall and the corner land may be at a corner of the base tray between a second side wall of the base tray opposite the first side wall and the base tray end wall.

The second tray may taper to a pouring corner spaced between the first flange portion and the second flange portion.

The protuberance may be a first protuberance with a first protuberance indent and there may be a second inwardly directed protuberance having a second protuberance indent in its upper surface at least partially surrounded by a second protuberance indent wall, the second protuberance indent wall extending continuously along an inward side of the second protuberance indent so as to separate the second protuberance indent from the main cavity formed by the base tray walls, the second protuberance located at the second base tray side wall.

The second tray may abut the second protuberance and the base tray end wall, such that the second tray is further located by the second protuberance and the base tray end wall.

The second tray may have a third flange portion supported on the second protuberance upper surface and the pouring corner may be at the third flange portion.

The base tray may have a circumferential land incorporating the corner land, the upper surface of the first protuberance and the upper surface of the second protuberance.

The second tray may have a circumferential flange incorporating the first flange portion, the second flange portion and the third flange portion.

There may be a first food component in the base tray and a second food component in the second tray, the second food component comprising a sauce.

The corner land may be a first corner land and a second corner land may be diagonally across from the first corner land, the second corner land having a second corner indent in its upper surface at least partially surrounded by a second corner indent wall, the second corner indent wall extending continuously along an inward side of the second corner indent so as to separate the second corner indent from the main cavity formed by the base tray walls.

The first protuberance may be a first column extending upwardly from a bottom wall of the base tray and the second protuberance may be a second column extending upwardly from the bottom wall of the base tray.

There may be a series of wells in the bottom wall of the base tray.

A bottom wall of the second tray may be free of openings such that the bottom wall of the second tray is steam impervious.

The bottom wall of the second tray may be spaced above a bottom wall of the base tray when the second tray is nested in the base tray.

A third tray may be nested in the base tray having a third tray flange portion supported by the upper surface of the second protuberance, the third tray flange portion extending over the second protuberance indent.

Other features and advantages of the present invention will be apparent from the following detailed description in conjunction with the drawings.

BRIEF DESCRIPTION OF THE DRAWINGS

In the drawings which illustrate aspects of this invention.

DETAILED DESCRIPTION

Figure 1:
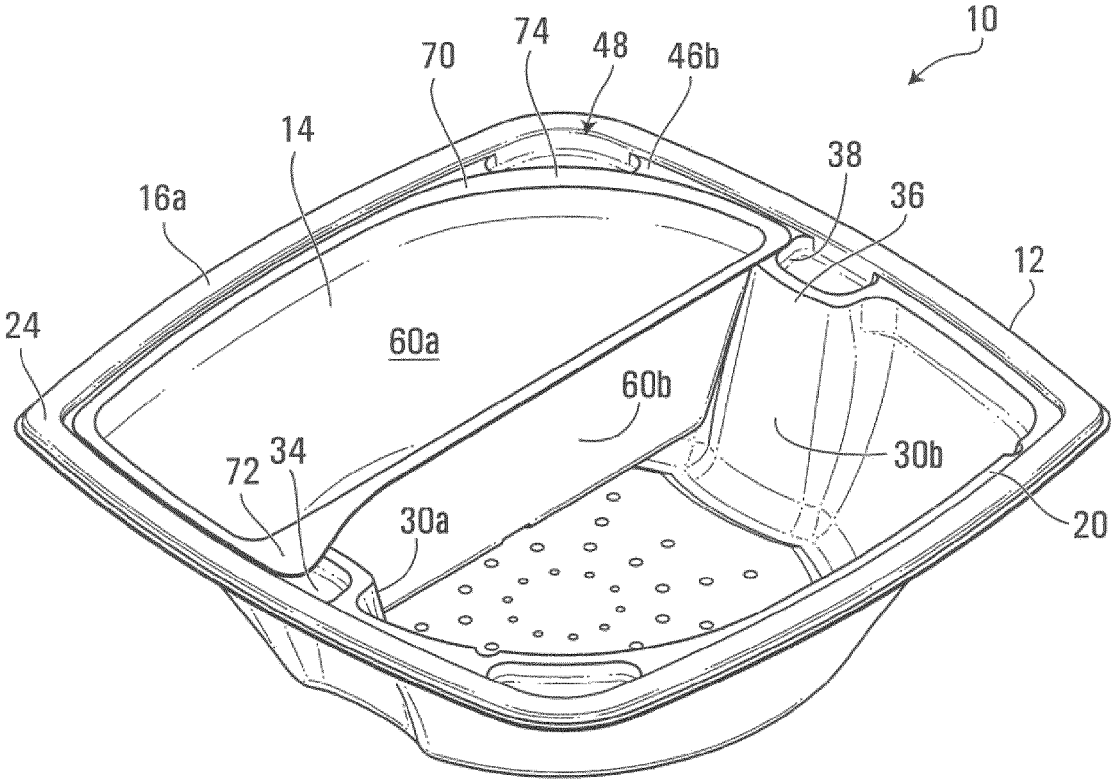
FIG. 1 is a perspective view of food packaging made in accordance with an embodiment.
Figure 2:
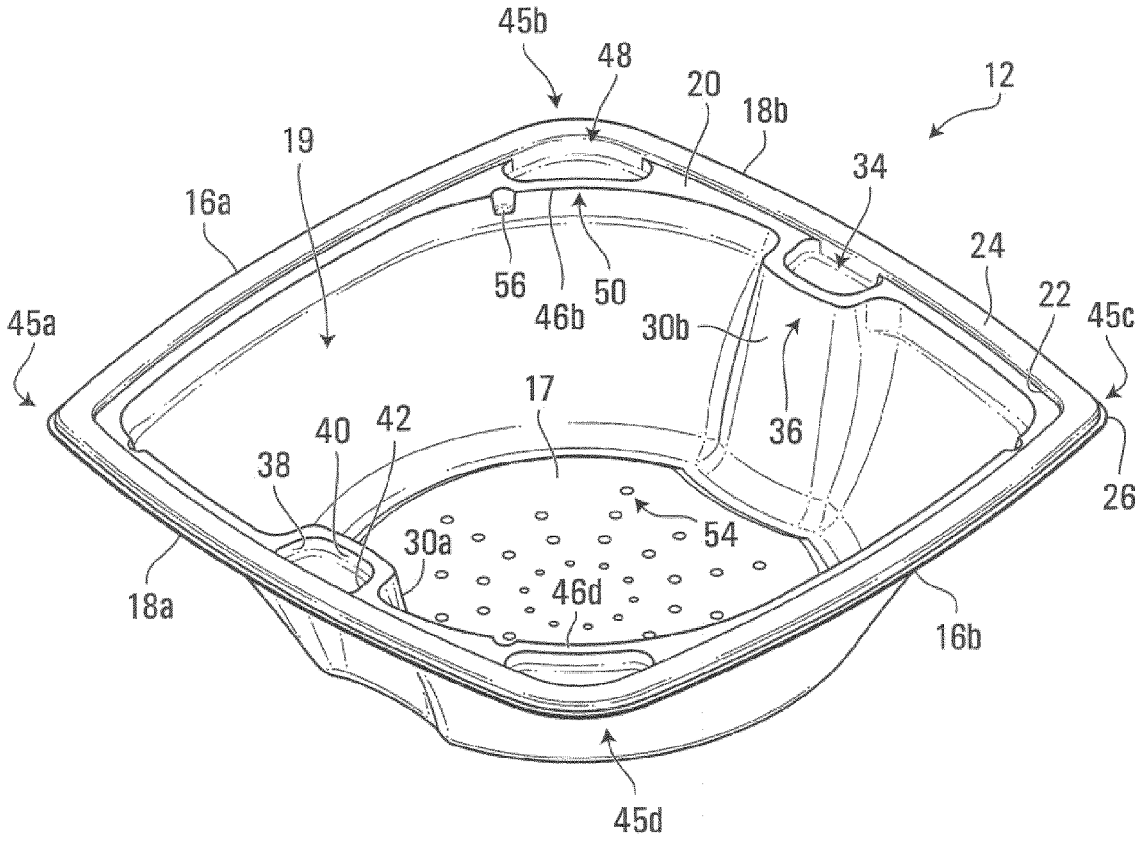
FIG. 2 is a perspective view of a base tray of the packaging of FIG. 1.
Figure 2A:
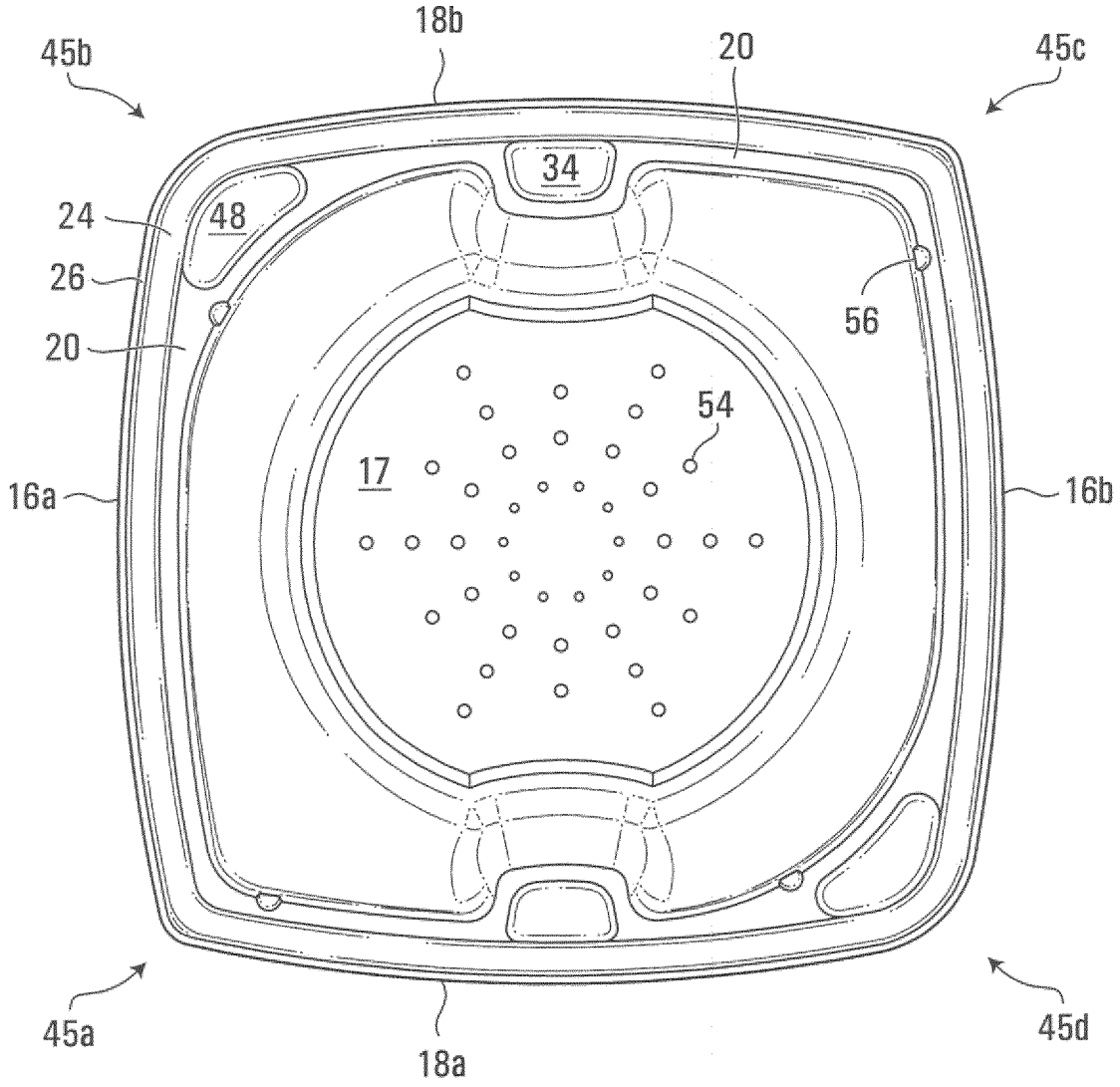
FIG. 2A is a top view of the tray of FIG. 2.

Turning to FIG. 1, food packaging 10 has a base tray 12 and an upper tray 14 which nests within the base tray.

Turning to FIGS. 2, 2A, 6 and 6A, the base tray 12 has a pair of end walls 16*a*, 16*b*; a pair of side walls 18*a*, 18*b*; and a bottom wall 17 defining a cavity 19. The side and end walls extend upwardly to a circumferential lower land 20. An upward step 22 defines the outer periphery of the lower land and the upward step terminates at an upper land 24. The outer periphery of the upper land terminates in a depending reinforcing rib 26.

Each side wall 18*a*, 18*b* has an inwardly directed protuberance 30*a*, 30*b*, respectively. Each protuberance is a vertical column extending upwardly from the bottom wall 17 of the base tray. Each protuberance has a protuberance indent 34 in its upper surface which is partially surrounded by a protuberance indent wall 36, the top surface of which is part of the lower land 20. As will be apparent from the figure, this indent wall extends continuously along a first end 38 of the indent, along an inward side 40 of the indent and along a second end 42 of the indent which is opposite to end 38 of the indent so as to separate the indent 34 from cavity 19 of the base tray.

At the corners 45*a*, 45*b*, 45*c*, and 45*d* of the base tray, there are corner lands which are part of the circumferential lower land 20. Two of these corner lands, namely corner lands 46*b*, 46*d*, have corner indents 48 in their upper surfaces. These corners lands 46*b*, 46*d* are diagonally across from each other: corner land 46*b* is at corner 45*b* which is formed by end wall 16*a* and side wall 18*b* and corner land 46*d* is at corner 45*d* which is formed by side wall 16*b* and side wall 18*a*. Each corner indent 48 is partially surrounded by a corner indent wall 50, the top surface of which is part of the lower land 20. As will be apparent from the figure, each corner indent wall extends continuously along an inward side 52 of the corner indent so as to separate the indent 48 from cavity 19 of the base tray.

Corners 45*b* and 45*d* at the inner periphery of the inner land 20 are rounded whereas corners 45*a* and 45*c* at the inner periphery of the inner land 20 are relatively sharp.

The bottom wall 17 of the base tray has a series of hemispherical wells 54. There is a nesting lug 56 proximate each of the four corners of the base tray and located at the inner periphery of the lower land 20.

Figure 3:
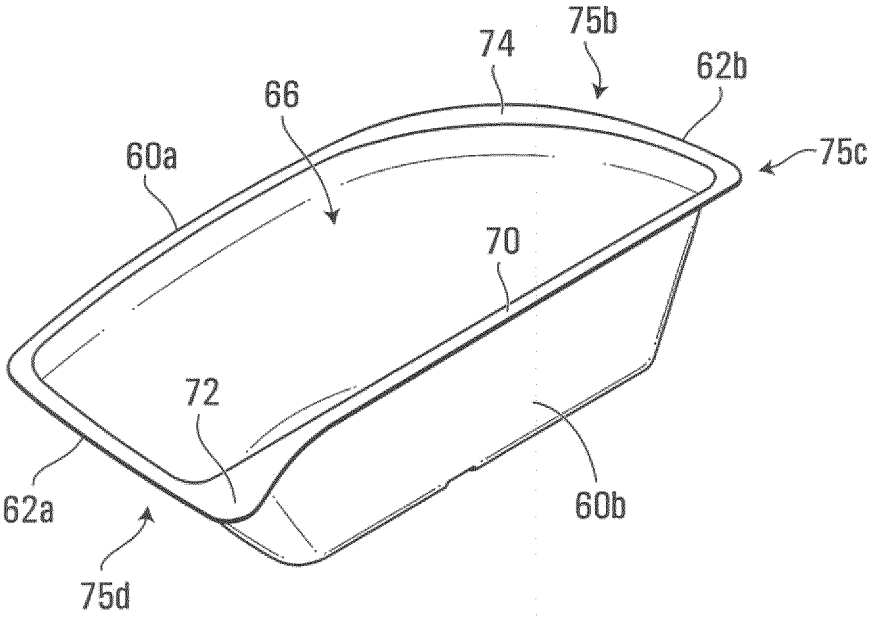
FIG. 3 is a perspective view of an upper tray of the packaging of FIG. 1.
Figure 3A:
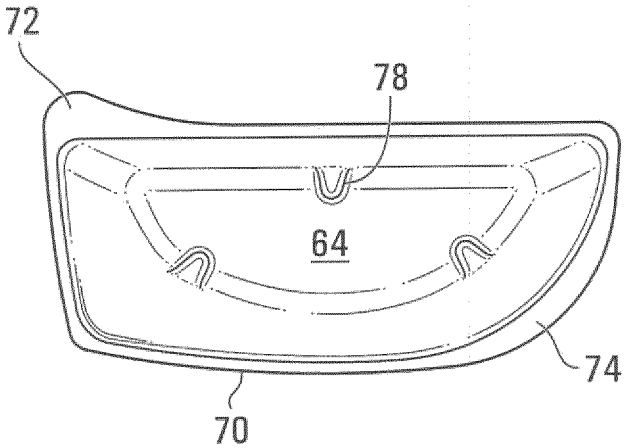
FIG. 3A is a bottom view of the upper tray of FIG. 3.

Turning to FIGS. 3 and 3A, upper tray 14 has a pair of side walls 60*a*, 60*b*, a pair of end walls 62*a*, 62*b* and a bottom wall 64 defining a cavity 66. As will be apparent from FIG. 3A, the bottom wall 64 is free of openings such that the bottom wall is steam impervious. The upper end of the side and end walls terminate in a circumferential, outwardly extending, flange 70. Circumferential flange 70 has a first widened flange portion 72 at a corner 75*d* where side wall 60*b* meets end wall 62*a* and a second widened flange portion 74 at a rounded corner 75*b* where side wall 60*a* meets end wall 62*b*. Thus, these widened flange portions are diagonally across from one another.

The upper tray tapers to a pouring corner 75*c* between the first widened flange portion 72 of corner 75*d* and the second widened flange portion 74 of corner 75*b*.

The bottom wall 64 of the upper tray has a number of upwardly directed nesting lugs 78.

Returning to FIG. 1, upper tray 14 may be nested in base tray 12 with the upper tray flange 70 resting on lower land 20 of the base tray. The upper tray 14 is located in the base tray by base tray end wall 16*a* and the protuberances 30*a*, 30*b*. More specifically, side wall 60*a* of upper tray 14 abuts base tray end wall 16*a* and side wall 60*b* of the upper tray abuts protuberances 30*a* and 30*b*. Thus, the upper tray is restrained against movement while nested in the base tray.

It will further be noted that with the upper tray nested in the base tray, widened flange portion 72 of the upper tray rests on top of a portion of the protuberance wall 36 of protuberance 30*a* and extends partially over protuberance indent 34 of protuberance 30*a*. This indent 34 is sized, and the extent of the overlap is chosen, so that a finger can be inserted into the indent below flange portion 72. Furthermore, with the upper tray nested, widened flange portion 74 extends partially over corner indent 48 of corner land 46*b*. Again, indent 48 is sized and the extent of the overlap is chosen so that a finger can be inserted into the indent 48 below flange portion 74.

A third portion of the flange 70, at corner 75*c*, rests on a portion of lower land 20 which forms the part of the protuberance wall 36 which extends along end 38 of the protuberance 30*b*. With both widened flange portion 72 and the portion of the flange at corner 75*c* supported on the protuberances 30*a*, 30*b*, the upper tray is supported along a portion of side wall 60*b*.

The depth of the upper tray is chosen so that when the upper tray is nested in the base tray, the bottom wall 64 of the upper tray 14 is spaced above the bottom wall 17 of the base tray 12.

Figure 4:
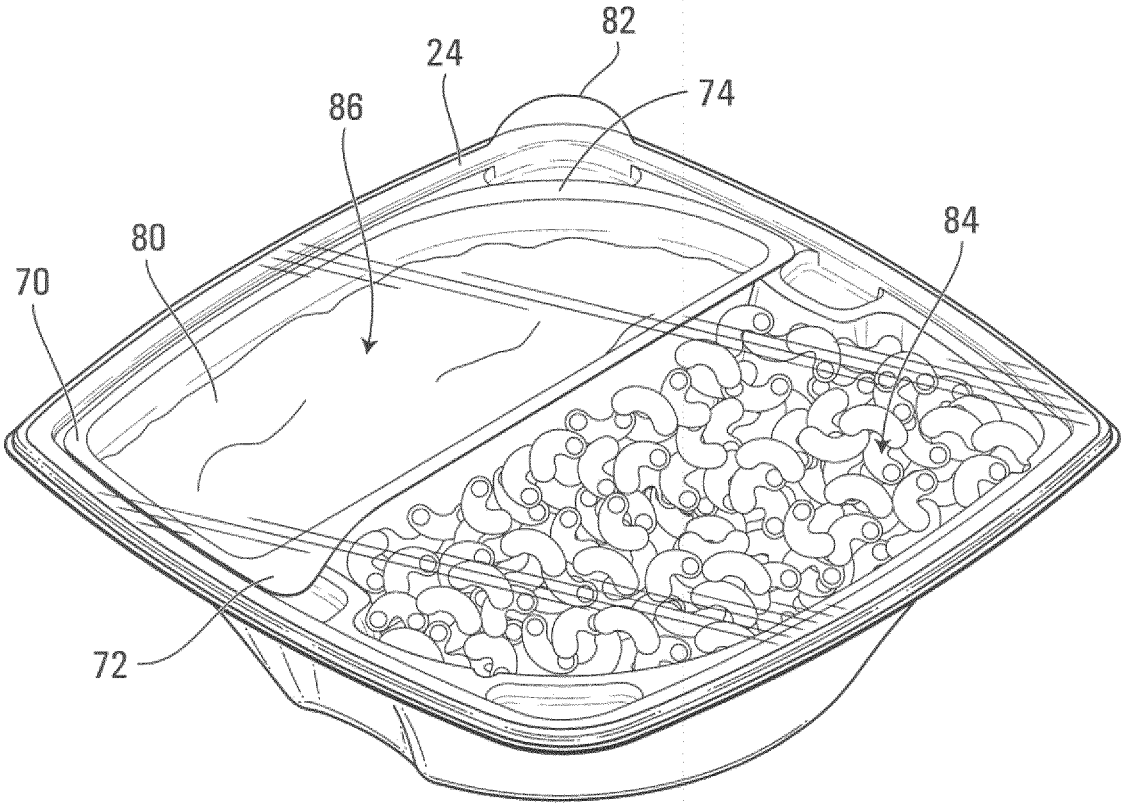
FIG. 4 is a perspective view of the food packaging of FIG. 1 shown containing food components and covered by a topping film.

The height of the upward step 22 of the base tray is chosen so that with upper tray 14 nested within base tray 12, an upper surface of the circumferential flange 70 of the upper tray and an upper surface of the circumferential upper land 24 of the base tray lie in a common plane. As shown in FIG. 4, this allows a topping film 80 to be adhered to the circumferential upper land 24 and to the circumferential flange 70. The topping film may be a peelable film and have a tab 82 to facilitate its removal.

Food packaging 10 can be used to package a convenience food. For example, with continued reference to FIG. 4, base tray 12 may hold a first component 84 of a convenience food, such as a pasta or a pasta and a protein (as, for example, a meat), and upper tray 14 may hold a second food component 86, such as a sauce.

Both the base tray 12 and nested tray 14 may be made of a microwaveable plastic material.

A convenience food producer may employ stacks of base trays 12 and upper trays 14. Nesting lugs 56 of the base tray facilitate removal of a base tray from a stack of base trays. Nesting lugs 78 of the upper tray have a similar purpose.

To package a convenience food, a first food component may be added to a base tray 12, a second food component to an upper tray 14, and the upper tray placed into nesting relation with the base tray. Next topping film 80 may be adhered to the upper land 24 of the base tray and, optionally, to the flange 70 of the upper tray. The topping film may be a self-venting film or a steam impervious film. Typically, the food components will be frozen. To prepare the convenience food, the consumer may simply place the filled food packaging of FIG. 4 in the microwave where the film 80 is self-venting. If the film is not self-venting, a portion of the film may be peeled back or the film may be punctured prior to microwave heating or cooking.

During microwave heating or cooking, the wells 54 in the bottom wall 17 of the base tray may serve as a repository for moisture that may rise through the first food component as steam.

Where topping film 80 is a peelable film, at the conclusion of microwave heating or cooking, the consumer may grasp tab 82 and pull to peel away film 80. Next the consumer may insert a finger of one hand into indent 34 and under widened flange portion 72 and the finger of another hand into indent 48 and under widened flange portion 74. It may be expected that the contents of the base tray and upper tray will continue to steam when removed from the microwave. However, when the consumer inserts a finger into indent 34 of protuberance 30*a*, the consumer's finger is isolated from steam rising from the base container by virtue of wall 36 that separates indent 34 from cavity 19 of the base tray. Similarly, when the consumer inserts a finger into indent 48 of corner land 46*b*, the consumer's finger is isolated from steam rising from the base container by virtue of wall 50 that separates indent 48 from cavity 19 of the base tray.

The consumer may then grasp these widened flange portions 72, 74 between the thumb and finger of both hands to lift the upper tray from the base tray. In this regard, since the widened flange portions are thin, they will quickly cool such that the consumer should be able to grasp these flange portions without discomfort. Because the widened flange portions 72, 74 are diagonally across from one another, the consumer will be able to control upper tray 14 from these two grasping points. Therefore, with a grasp on widened flange portions 72 and 74, the consumer may tip the upper container toward corner 75*c* to pour the second food component from upper tray 14 into base tray 12. Advantageously, the consumer can choose the portion of the second food component to pour onto the first food component. Further, the separation of the foods in the trays during heating or cooking can improve the taste experience of the prepared food.

Packaging 10 also allows for the possibility of preparing each of the first and second food components separately. Thus, for example, the upper tray could be removed from the base tray and the base tray placed by itself into the microwave. The upper tray could then be separately placed in the microwave (allowing the second food component 86 to be heated or cooked for a different length of time than the first food component 84) or, possibly, the second food component could be used without need for microwave heating.

In other embodiments, the first and second food components may be designed to be consumed in a frozen state. Further, it could be that only the second food component was designed to be heated (e.g., a sauce for ice cream) and the first food component (e.g., ice cream) left frozen.

Packaging 10 allows for all of these possibilities.

Optionally, the topping film could be only adhered to the upper land 24 of the base tray and not to the flange 70 of the upper tray. In this instance, upward step 22 could be larger so that the upper tray nested lower in the base tray. Further, with the topping film only adhered to the upper land 24, the lower land 20 would not need to extend continuously around the circumference of the base tray and flange 70 would also not need to extend continuously around the circumference of the upper tray. Instead, there could be flange portions at the four corners of the upper tray 14 to allow the upper tray to be supported on corresponding lower lands of the base tray. This may not be an optimal design, however, as the circumferential flange 70 also acts to stiffen the upper tray.

The trays could, of course, have other shapes. The hemispherical wells 54 could also have other shapes, such as channel shapes.

Figure 5:
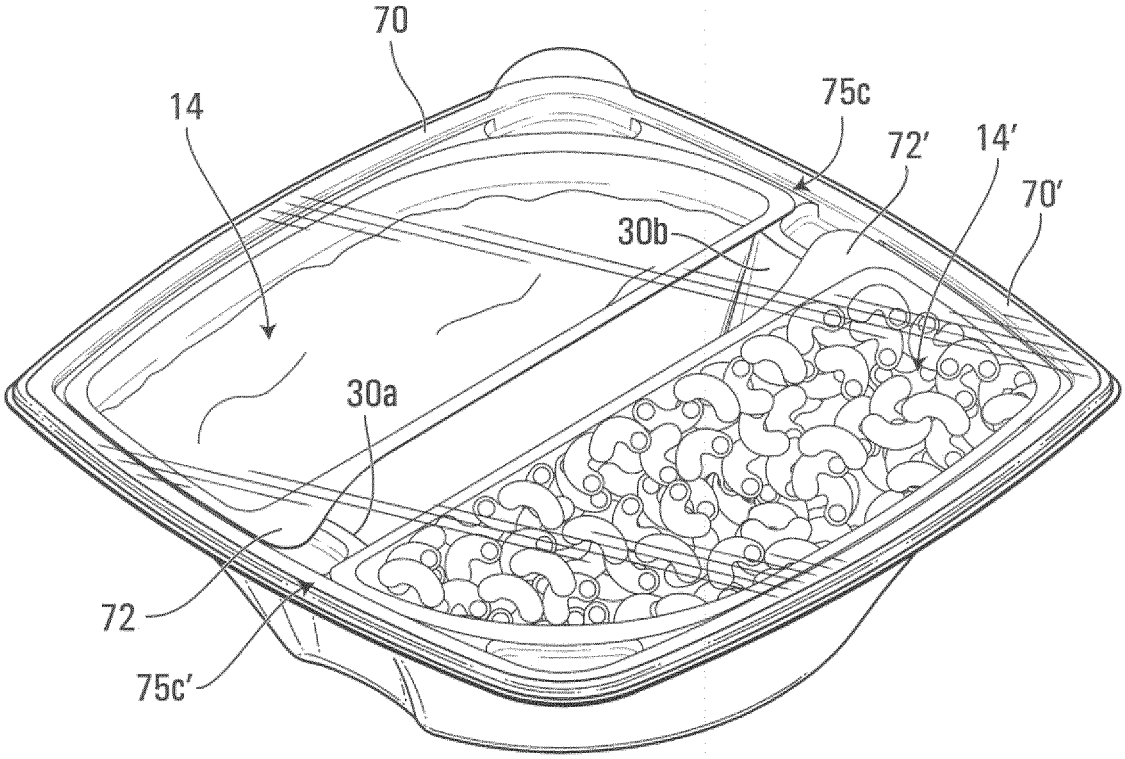
FIG. 5 is a perspective view of food packaging made in accordance with another embodiment.
Figure 6:
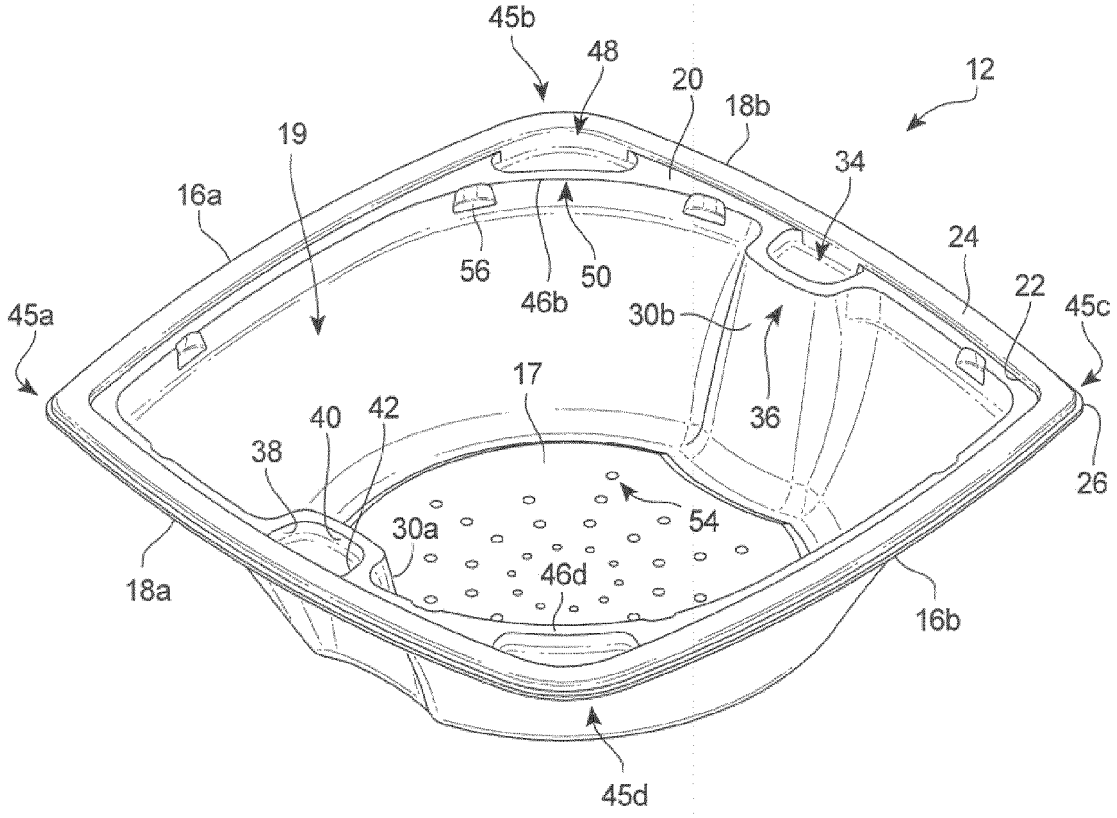
FIG. 6 is a perspective view of a base tray of the packaging of FIG. 1.
Figure 6A:
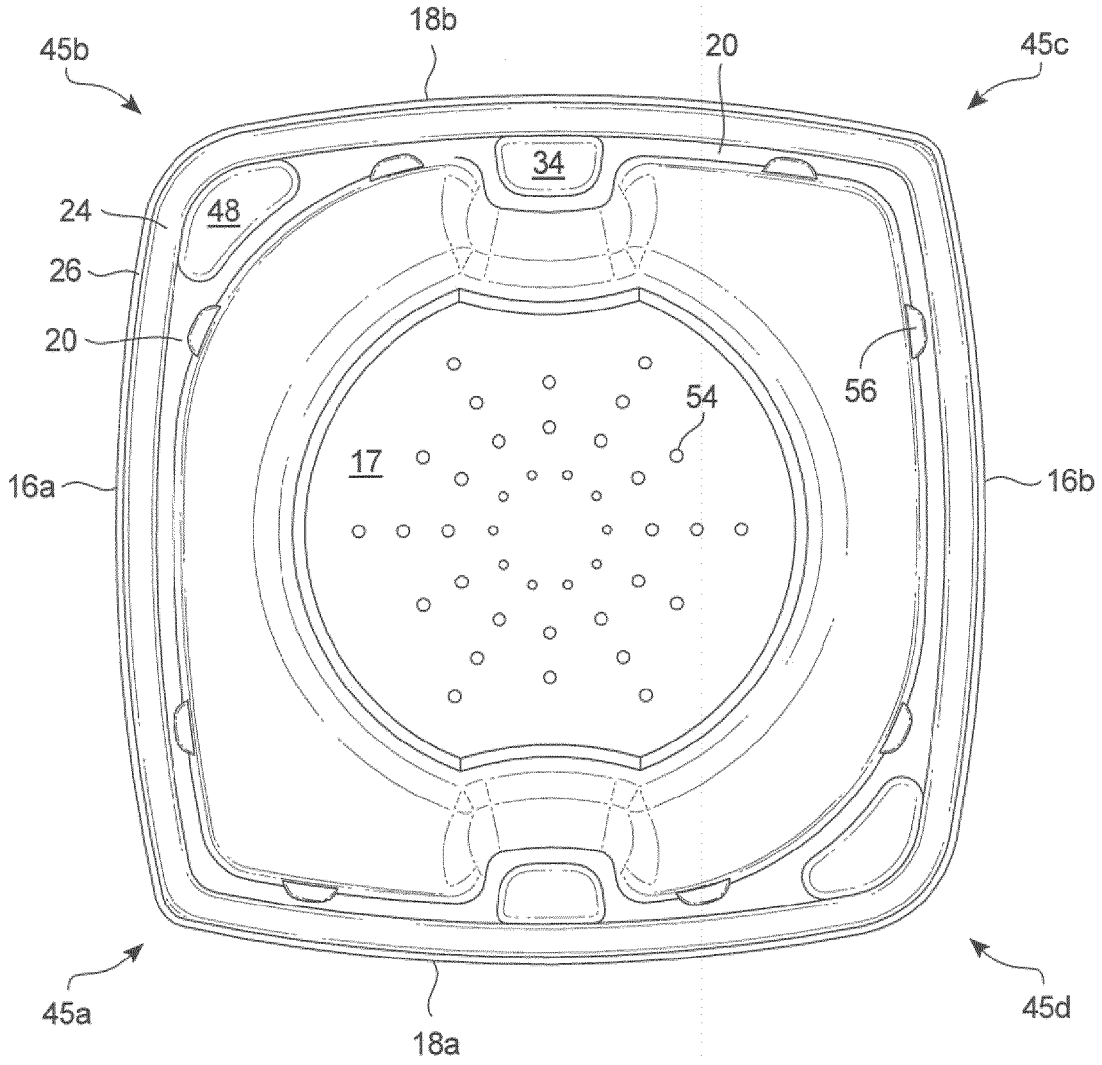
FIG. 6A is a top view of the tray of FIG. 2.

In a further embodiment, as shown in FIG. 5, two upper trays 14, 14' are nested in base tray 12 with the upper trays 14, 14' having opposite orientations. Thus, widened flange portion 72 of tray 14 and flange 70' at corner 75*c'* of tray 14' are supported on protuberance 30*a* while flange 70 at corner 75*c* of tray 14 and widened flange portion 72' of tray 14' are supported on protuberance 30*b*. The shape of base tray 12 allows the two upper trays 14, 14' to nest into the base tray in this way.

Other features of the invention will be apparent to those skilled in the art and, therefore, the invention is defined in the claims.

The invention claimed is:

1. A food packaging comprising:

a base tray with walls terminating in a protuberance land, the protuberance land having an upper surface comprising a protuberance indent at least partially surrounded by an indent wall, the indent wall extending continuously along an inward side of the protuberance indent to separate the protuberance indent from a main cavity formed by the base tray walls, and the base tray comprising (1) an inwardly directed protuberance comprising a protuberance upper surface comprising the protuberance indent and (2) a corner land comprising a corner land upper surface comprising a corner indent at least partially surrounded by a corner indent wall, the corner indent wall extending continuously along an inward side of the corner indent to separate the corner indent from the main cavity formed by the base tray walls; and a second tray nested in the base tray and comprising a first flange supported by the protuberance land and a second flange portion supported by the corner land, the first flange extending partially over the protuberance indent, the protuberance indent sized to admit a finger within the protuberance indent below the first flange, the protuberance is located at a base tray side wall, the second tray abutting the inwardly directed protuberance and a base tray end wall such that the second tray is located by the inwardly directed protuberance and the base tray end wall, and the second flange portion configured to extend partially over the corner indent when the second tray is fully seated in the base tray such that the corner indent is accessible to admit a finger when the second tray is fully seated in the base tray.

2. The packaging of claim 1, wherein the protuberance land is a circumferential lower land and further comprising an upward step from the lower land to a circumferential upper land outbound of the lower land.

3. The packaging of claim 2, wherein the first flange of the second tray is circumferential, and an upper surface of the first flange and an upper surface of the circumferential upper land of the base tray lie in a common plane.

4. The packaging of claim 3 comprising a topping film adhered to the circumferential upper land and to the flange.

5. The packaging of claim 1 wherein the inwardly directed protuberance is a vertical column extending upwardly from a bottom wall of the base tray.

6. The packaging of claim 1, wherein the corner indent is sized to admit a finger within the corner indent below the second flange portion.

7. The packaging of claim 6 wherein the base tray side wall is a first base tray side wall and wherein the corner land is at a corner of the base tray between a second side wall of the base tray opposite the first side wall and the base tray end wall.

8. The packaging of claim 7 wherein the second tray tapers to a pouring corner spaced between the first flange portion and the second flange portion.

9. The packaging of claim 8 wherein the inwardly directed protuberance is a first protuberance with a first protuberance indent, the packaging comprising a second inwardly directed protuberance comprising an upper surface comprising a second protuberance indent at least partially surrounded by a second protuberance indent wall, the second protuberance indent wall extending continuously along an inward side of the second protuberance indent to separate the second protuberance indent from the main cavity formed by the base tray walls, the second inwardly directed protuberance located at the second base tray side wall.

10. The packaging of claim 9 wherein the second tray abuts the second inwardly directed protuberance and the base tray end wall, such that the second tray is further located by the second inwardly directed protuberance and the base tray end wall.

11. The packaging of claim 10 wherein the second tray has a third flange portion supported on the second protuberance upper surface and wherein the pouring corner is at the third flange portion.

12. The packaging of claim 11 wherein the base tray has a circumferential land incorporating the corner land, the upper surface of the first inwardly directed protuberance and the upper surface of the second inwardly directed protuberance.

13. The packaging of claim 12 wherein the second tray has a circumferential flange incorporating the first flange portion, the second flange portion and the third flange portion.

14. The packaging of claim 13 further comprising a series of wells in a bottom wall of the base tray.

15. A food packaging comprising:

a base tray comprising side walls, end walls and a bottom wall that form a main cavity, and upper ends of the side and end walls terminate in a land, the base tray comprises a first protuberance directed inwardly from a first side wall of the base tray, and the base tray comprises a second protuberance directed inwardly from a second side wall of the base tray, the first side wall is opposite from the second side wall, the first protuberance having an upper surface comprising a first indent, the upper surface of the first protuberance comprises a first indent wall at least partially surrounding the first indent and extending continuously along an inward side of the first indent to separate the first indent from the main cavity, the second protuberance having an upper surface comprising a second indent, the upper surface of the second protuberance comprises a second indent wall at least partially surrounding the second indent and extending continuously along an inward side of the second indent to separate the second indent from the main cavity, the land comprises the upper surfaces of the first and second protuberances;

a first upper tray nested in the base tray and having a first upper tray flange supported by the first protuberance, the first upper tray flange extending partially over the first indent, the first indent sized to admit a finger within the first indent below the first upper tray flange when the first tray is fully seated in the base tray; and a second upper tray nested in the base tray and having a second upper tray flange supported by the second protuberance, the second upper tray flange extending partially over the second indent, the second indent sized to admit a finger within the second indent below the second flange when the second tray is fully seated in the base tray.

16. The food packaging of claim 15, wherein:

the first upper tray flange rests on the first and second protuberances and a portion of the land on a first end wall, and the second upper tray flange rests on the first and second protuberances and a portion of the land on the second end wall.

17. The food packaging of claim 15, wherein the land is a circumferential land that forms an upper periphery of the main cavity.

18. The food packaging of claim 15 wherein the first and second protuberances are vertical columns extending upwardly from the bottom wall of the base tray.

* * * * *